US008276519B2

(12) United States Patent
Menefee, III et al.

(10) Patent No.: US 8,276,519 B2
(45) Date of Patent: Oct. 2, 2012

(54) WAD-LESS CARTRIDGES AND METHOD OF MANUFACTURING THE SAME

(75) Inventors: James Y. Menefee, III, Macon, GA (US); Kenneth G. Bennett, Byron, GA (US)

(73) Assignee: Polywad, Inc., Roberta, GA (US)

( * ) Notice: Subject to any disclaimer, the term of this patent is extended or adjusted under 35 U.S.C. 154(b) by 90 days.

(21) Appl. No.: 12/885,202

(22) Filed: Sep. 17, 2010

(65) Prior Publication Data

US 2011/0017090 A1 Jan. 27, 2011

Related U.S. Application Data

(63) Continuation-in-part of application No. 11/281,755, filed on Nov. 17, 2005, now Pat. No. 7,814,820.

(51) Int. Cl.
*F42B 7/08* (2006.01)

(52) U.S. Cl. ..... 102/450

(58) Field of Classification Search ..... 86/29; 102/430, 102/431

See application file for complete search history.

(56) References Cited

U.S. PATENT DOCUMENTS

| | | | | |
|---|---|---|---|---|
| 458,679 | A | | 9/1891 | Beardsley et al. |
| 487,028 | A | | 11/1892 | Ginalsky |
| 1,153,860 | A | | 9/1915 | Butler |
| 1,857,281 | A | | 5/1932 | Johnson |
| 2,343,818 | A | | 3/1944 | Sweeley |
| 2,767,656 | A | | 10/1956 | Zeamer |
| 3,055,302 | A | | 9/1962 | Bayard et al. |
| 3,092,026 | A | | 6/1963 | Williams et al. |
| 3,113,483 | A | | 12/1963 | Puth |
| 3,195,461 | A | | 7/1965 | Freed |
| 3,368,489 | A | | 2/1968 | Herter |
| 3,370,534 | A | | 2/1968 | Herter |
| 3,402,664 | A | | 9/1968 | Cramer |
| 3,420,178 | A | | 1/1969 | Rempel |
| 3,469,527 | A | | 9/1969 | Pace |
| 3,491,690 | A | | 1/1970 | Knight |
| 3,577,924 | A | | 5/1971 | Findlay et al. |
| 3,599,568 | A | | 8/1971 | Shellnutt et al. |
| 3,653,326 | A | | 4/1972 | Howsam et al. |
| 3,669,023 | A | | 6/1972 | Moehlman et al. |
| 3,673,965 | A | | 7/1972 | Herter |
| 3,706,278 | A | * | 12/1972 | Stiefel et al. ..... 102/430 |
| 3,721,197 | A | | 3/1973 | Hughes et al. |
| 3,722,420 | A | | 3/1973 | Herter |
| 3,750,580 | A | | 8/1973 | Nomura et al. |
| 3,759,216 | A | | 9/1973 | Sanders et al. |
| 3,788,224 | A | | 1/1974 | Merritt |
| 3,827,363 | A | | 8/1974 | Curran |
| 3,877,381 | A | | 4/1975 | McCoy |
| 3,952,659 | A | | 4/1976 | Sistino |
| 3,996,865 | A | | 12/1976 | Dwyer |
| 4,162,645 | A | | 7/1979 | Abbott |
| 4,164,903 | A | | 8/1979 | Bouza |
| 4,173,930 | A | | 11/1979 | Faires, Jr. |

(Continued)

*Primary Examiner* — Michael Carone
*Assistant Examiner* — Reginald Tillman, Jr.
(74) *Attorney, Agent, or Firm* — Sutherland Asbill & Brennan LLP

(57) ABSTRACT

This disclosure relates generally to cartridges for use in projectile-launching devices, such as ammunition cartridges, flare cartridges, and the like, including components of the cartridges, and methods for their manufacture. For example, the cartridges of this disclosure can be ammunition cartridges such as shotshell cartridges, which include an obturating medium which functions to seal the compressed but expanding hot gases and can be used without a pre -formed gas seal.

20 Claims, 5 Drawing Sheets

U.S. PATENT DOCUMENTS

| | | | |
|---|---|---|---|
| 4,290,365 | A | 9/1981 | Dreyer |
| 4,307,664 | A | 12/1981 | Vollers |
| 4,815,388 | A | 3/1989 | Schluckebier et al. |
| 4,991,512 | A | 2/1991 | Van Wyk |
| 5,339,743 | A | 8/1994 | Scarlata |
| 5,361,701 | A | 11/1994 | Stevens |
| 5,471,931 | A | 12/1995 | Gardner |
| 5,623,118 | A | 4/1997 | Jackson |
| 5,710,391 | A | 1/1998 | Chetcuti |
| 5,864,486 | A | 1/1999 | Deming et al. |
| 5,979,330 | A | 11/1999 | Cornell |
| 6,067,909 | A | 5/2000 | Knoster, Jr. |
| 6,260,484 | B1 | 7/2001 | Billings |
| 6,367,388 | B1 | 4/2002 | Billings |
| 6,415,719 | B1 | 7/2002 | Buccelli et al. |

* cited by examiner

WAD-LESS CARTRIDGES AND METHOD OF MANUFACTURING THE SAME

CROSS REFERENCE TO RELATED APPLICATIONS

This application claims priority to, and is a continuation-in-part of, U.S. patent application Ser. No. 11/281,755, filed Nov. 17, 2005, now U.S. Pat. No. 7,814,820, which is hereby incorporated by reference in its entirety.

TECHNICAL FIELD OF THE INVENTION

This disclosure relates to cartridges for use in projectile-launching devices, such as ammunition cartridges, flare cartridges, and the like, including components of the cartridges, and methods for their manufacture.

BACKGROUND OF THE INVENTION

Usually, a cartridge such as a firearm shotshell is manufactured by inserting an ignition primer into an empty cartridge, also called a "case". A measured or selected amount of propellant is inserted or poured into the cartridge. The propellant has a portion thereof contiguous with the primer. A wad, manufactured from a fixed size of material such as cardboard ("nitro card"), cork, plastic and the like, is inserted into the cartridge. One portion of the wadding thereof is contiguous with the propellant.

A projectile, slug or slugs, pellets, spheres, cubes, etc. in any geometric shape may be inserted into the cartridge. The projectile(s) may, if desired, be manufactured from lead, iron or other suitable material, including non-toxic material. The projectile(s) has one portion thereof contiguous with the wadding material. The cartridge is closed by pressure fitting a portion of the cartridge around the projectile(s). The pressure fitting may be accomplished by rolling or folding the cartridge mouth onto the projectile, then crimping the distal edge of the cartridge around the projectile(s). A six or eight point fold or "star" crimp may typically be used in cartridges that contain multiple projectiles ("shot"). An overshot card of some material may be used with a roll crimp to contain shot loads. The loaded ammunition is ready to be used or packaged with other loaded ammunition.

Typically, ammunition is fired from a firearm by first placing the ammunition into the breach of the firearm. Examples of firearms are rifles, pistols, shotguns, muskets and military type weapons like artillery pieces. In firing the ammunition, a mechanical force is applied against the ignition primer causing an explosion. The resulting action ignites the propellant causing an expanding hot gas to propel the projectile(s) laterally along the bore of the firearm.

Practically, the firing sequence discussed above is ideal and the actual firing sequence includes the burning propellant gases, wadding, and projectile(s), entering a forcing cone before entering the bore of the firearm. The forcing cone is an area between the end of the cartridges in the breach and the bore of the firearm. The large end of the forcing cone is contiguous with the breach and the smaller end is contiguous with the bore. The forcing cone compresses the hot gas and wadding thereby increasing the force present on the projectile(s). If the wadding is not perfectly fitted in the cartridge hull, as well as fitting the chamber throat and forcing cone, the compressed hot gas may not obturate or seal the compressed hot gas. This results in a blow-by effect of the hot gas and possible loss of pressure and projectile speed, or balling of the shot, causing a decrease in the performance of the firearm. If the blow-by effect is sufficient, this may result in obstruction of the bore causing possible damage or rupture of the firearm when firing a second round of ammunition.

It would be desirable to have the full pressure of the compressed gas be developed and contained in the area of the hull, chamber and forcing cone without the blow-by effect. Further, it would be desirable to have a wadding system that does not require the wad to be manufactured or to be perfectly fitted in the cartridge or in the forcing cone.

SUMMARY OF THE INVENTION

The present disclosure provides an improved method and apparatus of manufacturing wad-less cartridges, such as wad-less shotshell ammunition. Traditionally, ammunition has a solid wad or wads disposed between the projectile and the propellant. In one aspect, this disclosure uses an obturating medium, typically comprising a suitable particulate material, such as polymer (polyethylene, polypropylene, and the like) disposed generally between the projectile and the propellant. When the propellant is activated and burns in the chamber of a firearm, the gases created in the chamber propel the projectile(s) and obturating medium forward out of the cartridge and throat of the barrel chamber and into the forcing cone. The expanding gases urge the entire ejecta forward, compressing all to the conical shape of the forcing cone and barrel diameter. The obturating medium also compresses to the conical shape of the forcing cone maintaining the gas seal about the end of the projectile(s) in the bore of the firearm. The structural components of the compressed obturating medium press outwardly against the sides of the forcing cone and the sides of the bore creating a load-bearing wall. The obturating medium acts not only as a superior seal, but also insulates the projectile(s) from the intense heat of the powder combustion, and, is unaffected by severely cold temperatures. The obturating medium also provides a cushion effect on the projectile(s) reducing deformation. The end portion of a single projectile receives pressure in urging it forward down the bore of the firearm but does not act as a load-bearing wall for the particulate material polymer. If a skirt, or other trailing appendage is present on the projectile, the non-load-bearing function of the components of this disclosure do not deform the skirt; thus, they do not distort the aerodynamic performance of the projectile.

While one embodiment of this disclosure is provided by a shotshell cartridge, as illustrated in the discussion and figures in detail, the methods of this disclosure are generally applicable to any type of cartridge that is intended to launch projectiles. For example, the methods and components disclosed here can be used to provide cartridges that include, but are not limited to: ammunition cartridges such as shotshell, rifle, or pistol cartridges; flare cartridges; grenade launcher cartridges; smoke flare cartridges; signaling device cartridges; chemical munitions cartridges; distraction device cartridges such as flash-bang cartridges; pyrotechnic launching device cartridges; and the like. Moreover, the cartridges of this disclosure are not limited as to any type of primer or primer composition, propellant, or projectile, as understood by one of ordinary skill. By way of example, the methods and components disclosed here can be applied in cartridges that use center fire or rim fire primer configurations.

Thus, according to one aspect, the present disclosure provides a cartridge comprising:

a) a cartridge case having a proximal end and a distal end and, comprising a primer situated at the proximal end;

b) a propellant, a portion of which is contiguous with the primer;

c) an obturating medium, a portion of which is contiguous with the propellant; and d) at least one projectile, a portion of which is contiguous with the obturating medium;

wherein the cartridge does not contain a pre-shaped gas seal.

In one aspect, the projectile can be an optional component of the cartridge. For example, the cartridge according to this disclosure can be a blank cartridge, or the cartridge can be used in conjunction with at least one projectile that is not integrated into that cartridge but is separate therefrom.

In accordance with another aspect of this disclosure, there is provided a cartridge comprising:

a) a cartridge case having a proximal end and a distal end and comprising a primer situated at the proximal end;

b) a propellant, a portion of which is contiguous with the primer;

c) an obturating medium selected from polyethylene, polypropylene, or a combination thereof, a portion of which is contiguous with the propellant;

d) optionally, a flow control additive combined with the obturating medium; and d) at least one projectile, a portion of which is contiguous with the obturating medium;

wherein the cartridge does not contain a pre-shaped gas seal, and the distal end of the cartridge is crimped closed or partially crimped about the at least one projectile.

In accordance with yet another aspect, the present disclosure provides a shotshell comprising:

a) a shotshell case having a proximal end and a distal end and comprising a primer situated at the proximal end;

b) a propellant, a portion of which is contiguous with the primer;

c) an obturating medium, for example a particulate material selected from polyethylene, polypropylene, or a combination thereof, a portion of which is contiguous with the propellant;

d) optionally, a flow control additive combined with the obturating medium; and e) at least one projectile selected from birdshot, buckshot, and slug projectiles, a portion of which is contiguous with the obturating medium;

wherein the shotshell does not contain a pre-shaped gas seal.

In still another aspect, this disclosure provides a cartridge comprising:

a) a cartridge case having a proximal end and a distal end and, comprising a primer situated at the proximal end;

b) a propellant, a portion of which is contiguous with the primer; and c) a particulate projectile material having obturating properties, a portion of which is contiguous with the propellant;

wherein the cartridge does not contain a pre-shaped gas seal.

When taken in conjunction with the accompanying drawings and the appended claim, features and advantages of the present disclosure become apparent upon reading the following detailed description of the various aspects and embodiments of this disclosure.

BRIEF DESCRIPTION OF THE DRAWINGS

Various aspects and embodiments of this disclosure are illustrated in the drawings in which like reference characters designate the same or similar parts throughout the figures.

DETAILED DESCRIPTION OF THE INVENTION

Figures 1A, 1B:
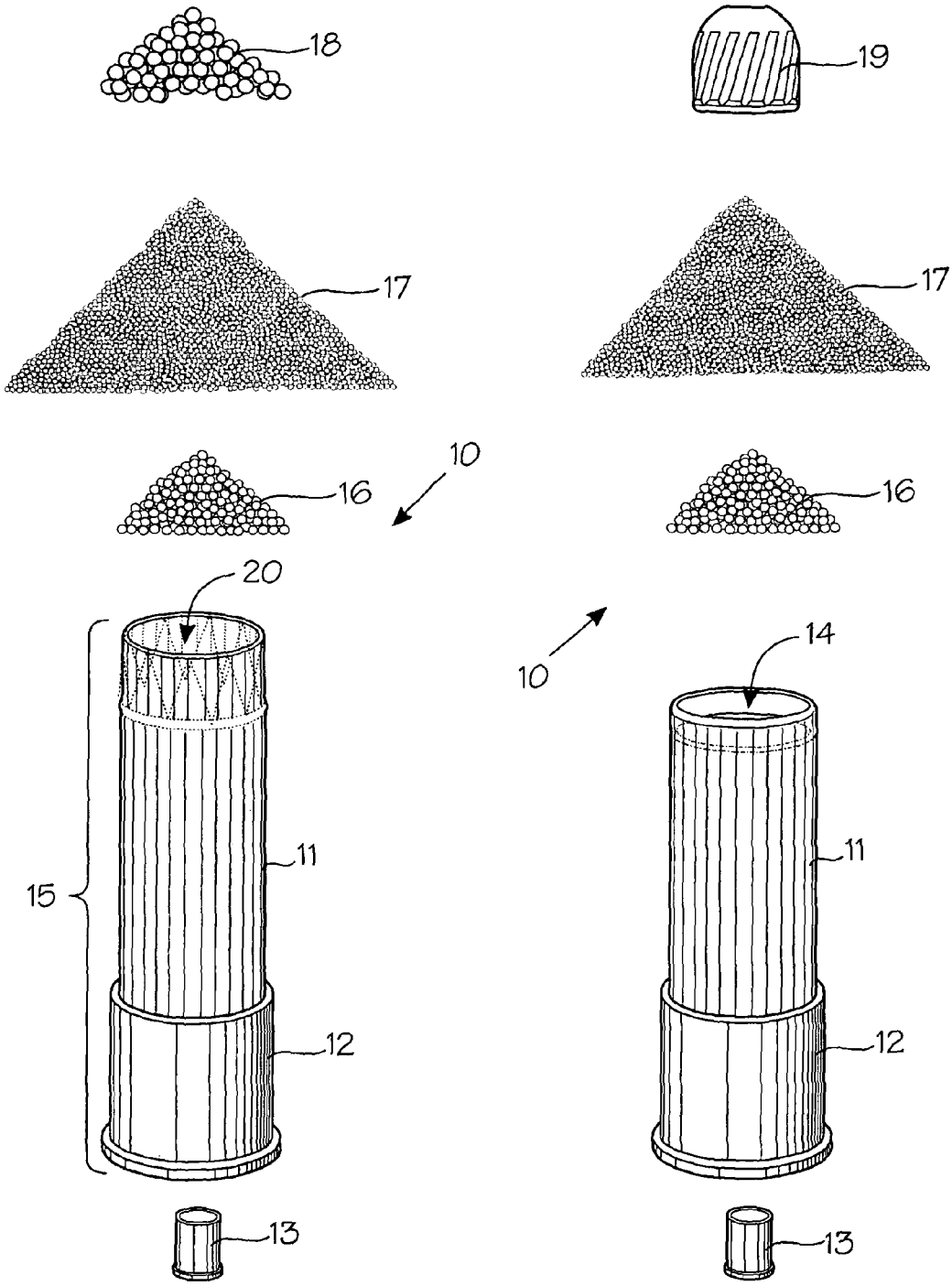
FIG. 1*a* illustrates a top-level schematic view diagram of the preferred embodiment of the present disclosure with small shot as the projectile.
FIG. 1*b* illustrates a top-level schematic view diagram of the preferred embodiment of the present disclosure with a solid projectile.
Figure 4:
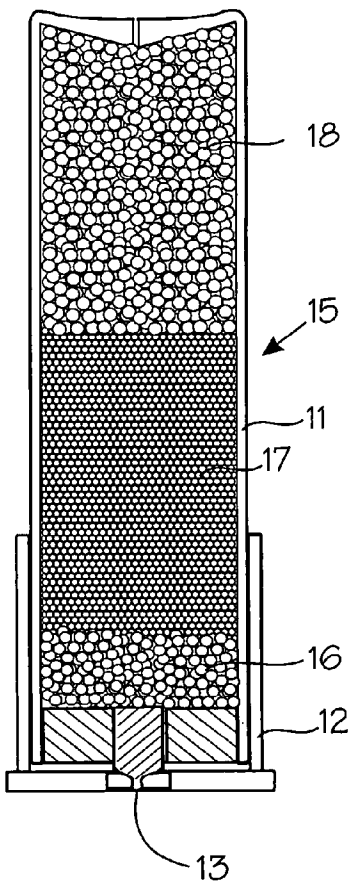
FIG. 4 illustrates a top-level schematic view diagram of the preferred embodiment of the present disclosure with a star crimped seal.
Figure 3:
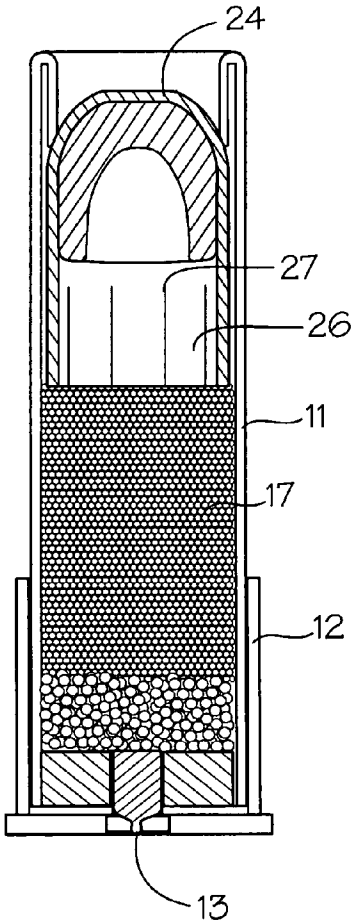
FIG. 3 illustrates a top-level schematic view diagram of the preferred embodiment of the present disclosure with a solid projectile wherein the projectile has a skirt disposed thereto, using a roll crimp seal.

The materials, articles, compositions, devices, and methods described herein may be understood more readily by reference to the following detailed description of specific aspects of the disclosed subject matter and to the Figures and their descriptions. It is to be understood that the aspects described below are not limited to specific methods or components or compositions, as such may, of course, vary. It is also to be understood that the terminology used herein is for the purpose of describing particular aspects only and is not intended to be limiting. For example, the description of a method of manufacturing the wad-less ammunition that includes steps such as "pouring" are meant to be exemplary, as methods of charging a selected quantity of a propellant into a cartridge other than "pouring" are encompassed by this description. Moreover, the term "wad-less" is used to mean that the finished cartridge does not contain a separate pre-shaped gas seal component. As the context allows, the term "cartridge" can refer to the finished manufactured article, such as a completed ammunition cartridge; however, in some contexts, the term "cartridge" may refer to the empty "casing" or "case" that is charged according to this disclosure to provide the finished article, as apparent from its particular use. Moreover, the cartridges and components of this disclosure are exemplified by, but not limited to, shotshell cartridges as illustrated in the figures; however, it is to be understood that the disclosure is applicable to a variety of cartridges for use in projectile-launching devices, such as ammunition cartridges, flare cartridges, and the like.

Before describing in detail the particular improved method and apparatus of manufacturing wad-less cartridges in accordance with the present disclosure, it is noted that among other things, this disclosure provides a novel structural combination of components. Accordingly, the structure, control and arrangement of these conventional components have, for the most part, been illustrated in the drawings by readily understandable schematic diagram representations. The drawings show only those specific details that are pertinent to the present invention in order not to obscure the disclosure with structural details which will be readily apparent to those skilled in the art having the benefit of the description herein. For example, a typical wad-less ammunition cartridge 15, FIG. 1*a* has a hull 11, a metal head 12 and a primer 13. Various portions of the interconnection of the hull 11, metal head 12 and the insertion of primer 13 have been simplified in order to emphasize those portions that are most pertinent to the disclosure. Thus, the schematic diagram illustrations of the Figures do not necessarily represent the mechanical structural arrangement of the exemplary wad-less shotshell ammunition, but are primarily intended to illustrate major structural components of the wad-less cartridges in a convenient functional grouping whereby the present disclosure may be more readily understood.

Figure 9:
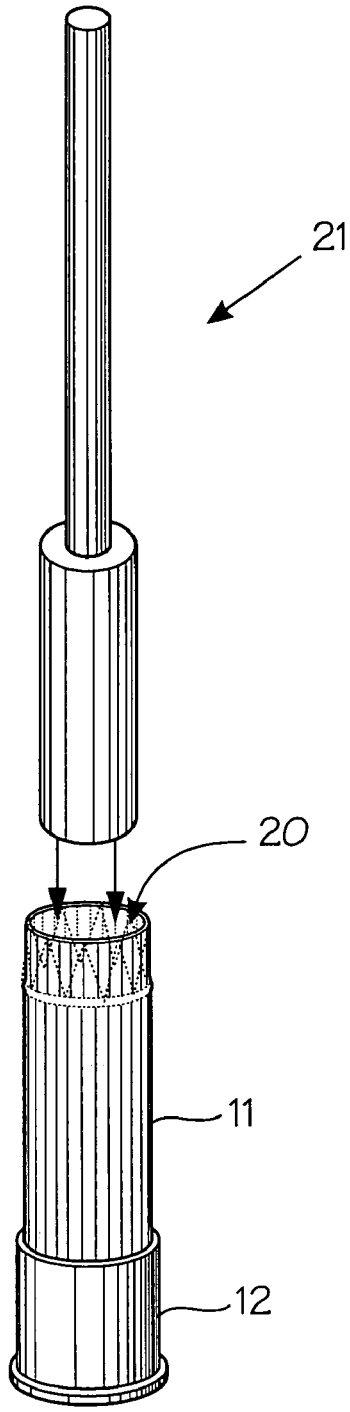
FIG. 9 illustrates a top-level schematic view diagram of a packing tool in concert with loading of a projectile cartridge.

A more detailed discussion of the cartridges of this disclosure can be understood by reference to wad-less shotshell ammunition 10, FIG. 1, according to this disclosure is provided as follows. In one aspect, the wad-less shotshell ammunition cartridge 15 may, if desired, have the hull 11 inserted into a cup shaped metal head bottom portion 12. The hull 11 may, if desired, be pressed into the cup shaped metal bottom portion 12 or inserted by any convenient means known in the art of making ammunition. The primer 13 provides the initial explosive charge to the cartridge 15 and is inserted into the center of cup 12. A selectively measured amount of appropriate propellant 16 is poured into the open end 20 of hull 11. The measured amount of propellant 16 may vary depending on the type of cartridge 15 that is being loaded. For example, the selected amount of propellant 16 for loading a 12-gauge shotgun hull is more in volume, and has different types of burning characteristics than is required for loading a 410-gauge shotgun hull. A selectively measured amount of particulate obturating medium 17 is poured into the open end 20 of hull 11 over the propellant 16. An example of the obturating medium 17 is small particles of polyethylene, available from numerous suppliers. Further, a selectively measured amount of spherically shaped projectiles 18 are poured into the open end 20 of hull 11 over the obturating medium 17. A solid projectile 19, FIG. 1*b* may, if desired, be substituted for the spherically shaped projectiles 18, FIG. 1. The measured amount of particulate obturating medium 17, spherically shaped projectiles 18 or the solid projectile 19 may vary depending on the type of cartridge 15 that is being loaded, as discussed above. A packing tool 21, FIG. 9 is inserted into the open end 20 and is urged forward into the hull 11. The packing tool 21 presses the air out of the mixture of obturating medium 17, spherically shaped projectiles 18 and propellant 16. If desired, a two-step packing operation may be performed by inserting the packing tool 21 into hull 11 over the propellant 16 and obturating medium 17. The air is pressed out of the mixture then the projectile or spherically shaped projectiles 18 are packed into the hull 11, more obturating medium is poured into the hull, then re-packed with a packing tool. The packing tool 21 is removed and the open end of hull 11 is reverse rolled and sealed 14 with a typical six point or eight point seal as known in the art. The manufactured cartridge 15 is complete and sealed, and various embodiments are shown in FIG. 2 through FIG. 6. The air has been pressed out of hull 11, obturating medium 17, spherically shaped projectiles 18 or solid projectile 19, and propellant 16.

Figure 2:
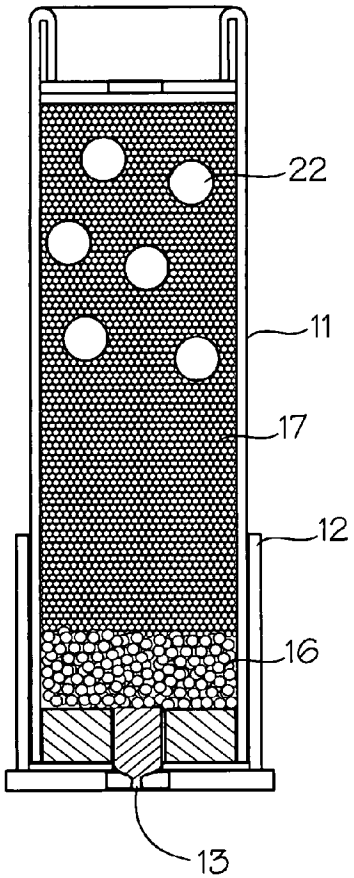
FIG. 2 illustrates a top-level schematic view diagram of the preferred embodiment of the present disclosure with large shot as the projectile.

Different types of projectiles and loading techniques may, if desired, be used with the wad-less ammunition 10 of the present disclosure, FIG. 2. Large spherically shaped projectiles 22 FIG. 2 or smaller shaped projectiles 23, FIG. 5 may, if desired, be intermixed with the particulate obturating medium or other "buffer" fillers commonly used with shot in shotshell 17 and loaded into hull 11. A solid projectile with a skirt 24, FIG. 3 may also be used with the wad-less ammunition 10.

Figure 7A:
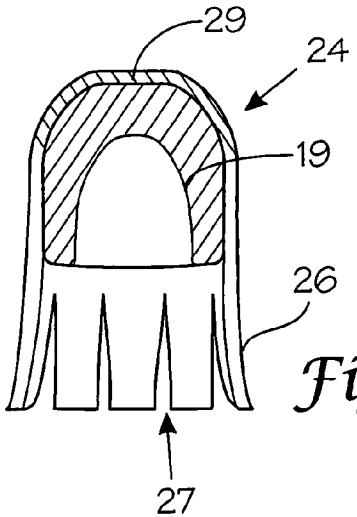
FIG. 7*a* illustrates a top-level schematic view diagram of a solid projectile with a skirt molded thereto wherein said skirt has slits disposed thereto.
Figure 7B:
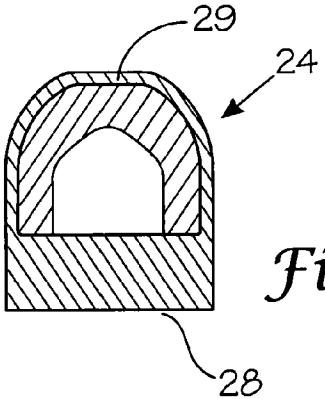
FIG. 7*b* illustrates a top-level schematic view diagram of a solid projectile with a solid skirt molded thereto.
Figure 6:
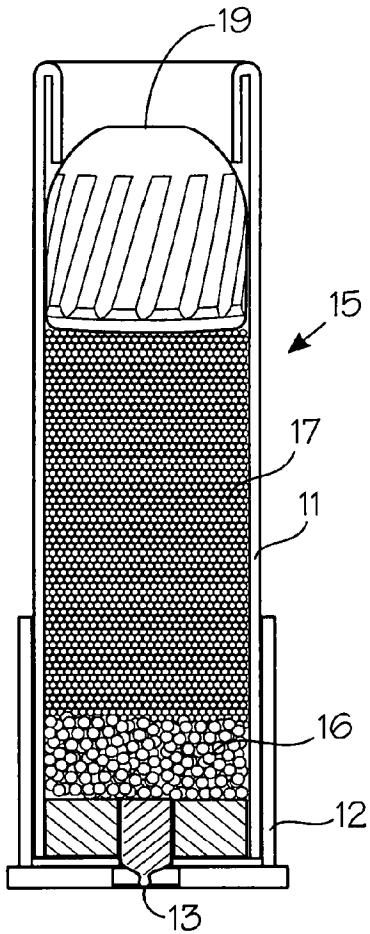
FIG. 6 illustrates a top-level schematic view diagram of the preferred embodiment of the present disclosure with solid projectile with a roll crimped seal.
Figure 5:
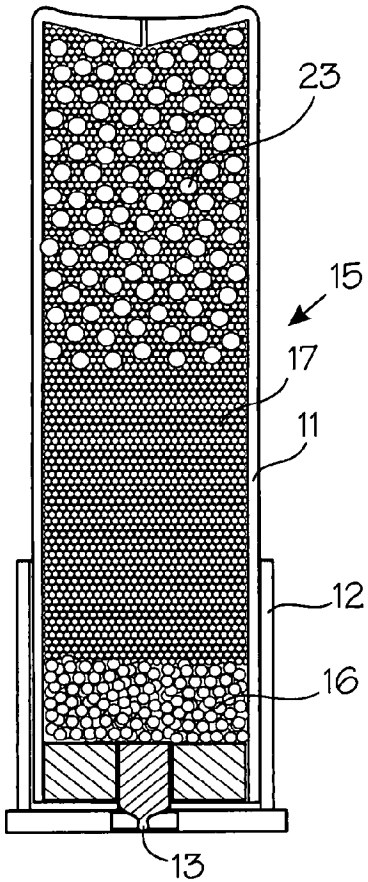
FIG. 5 illustrates a top-level schematic view diagram of the preferred embodiment of the present disclosure with loosely packed small shot projectile with a star crimped seal.
Figure 8:
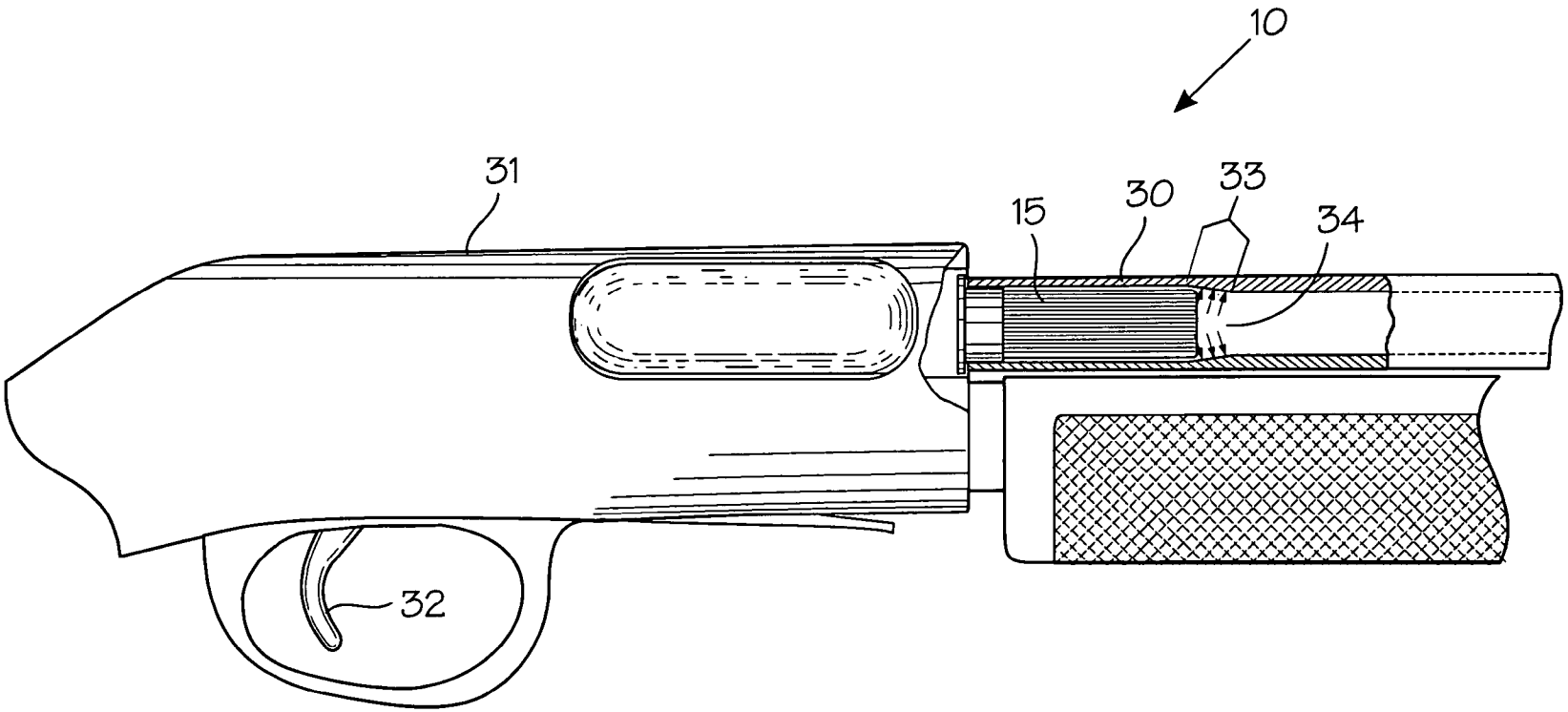
FIG. 8 illustrates a top-level schematic view diagram of a firearm's forcing cone.

The skirt 24 of the solid projectile 19, FIG. 7*a* may, if desired, surround, enclose or partially enclose the body of the solid projectile 19. The solid projectile 19 is substantially cylindrical in shape with one end 29 rounded. The other end 28 of solid projectile 19 is closed about the rear of the projectile, which may be partially hollow. The solid projectile 19 may, if desired, be manufactured from lead, iron or any other convenient or known material in the art of projectile manufacture, as further described herein. The lower portion 26 of skirt 24 may, if desired, extend below the closed end of the solid projectile 19. The lower portion 26 has a plurality of slits 27, FIG. 3 that are in close proximity to one another when loaded into hull 11. When the solid projectile 19 with skirt 24 attached is fired from a firearm the slits 27, FIG. 7*a* flare outwardly in flight. The skirt 24 may, if desired, be solid about the partially closed area of the projectile. The skirt 24 whether having a solid skirt or a skirt with slits has increased aerostability in flight. In addition, the skirt 24 shields the projectile from making contact with the bore of the firearm when the cartridge 15 is discharged.

In operation: The cartridge 15 loaded with selected projectile(s), as discussed above, is placed into the chamber 30 of the firearm 31. The user of the firearm 31 engages the trigger 32 wherein the firing-pin strikes the primer 13 causing an explosion and igniting the propellant 16. The propellant 16 burns creating gases in the chamber 30 and propelling the selected projectile(s) and obturating medium 17 forward into a forcing cone 33. The gases compressed to the conical shape of the forcing cone urge the obturating medium 17 and selected projectile(s) forward. The obturating medium 17 also compresses to the conical shape of the forcing cone creating and maintaining a gas seal 34 about the end of the selected projectile(s) in the bore of the firearm 31. The structural components of the compressed obturating medium 17 press outwardly against the sides of the forcing cone and then conform the sides of the bore creating a load-bearing wall. The end portion of the selected projectile(s) receives pressure urging it forward down the bore of the firearm 31 but it does not act as a load-bearing wall for the obturating medium 17. If a skirt, or other trailing appendage 24 is present on the selected projectile(s) the non-load-bearing function of the present wad-less ammunition 10 does not deform the skirt 24 thus not distorting aerodynamic performance of the present wad-less ammunition 10.

In one aspect, the material constituting the obturating medium can be in the form of particles of any shape. For manufacturing ease, the obturating medium generally can be free-flowing and non-agglomerated. A range of sizes and size distributions of particles are useful as obturating medium. According to one aspect and by way of example, a suitable obturating medium can be one that generally combines the properties of irregularly shaped particles and the small particle sizes disclosed herein. While not intending to be bound by theory, it is believed that, among other things, irregularly-shaped particles impart a high critical angle of repose to the obturating medium, which may also reflected in the ability of the particles to interlock or bridge. Also while not intending to be bound by theory, it is thought that under the extreme shear stress of the rapidly expanding combustion gases, the obturating medium behaves in a non-Newtonian fashion, conforming to parameters of the chamber throat or forcing cone and obturating the hot gases, while protecting and insulating the projectile(s).

There does not appear to be a lower limit of suitable particle sizes that work. As provided herein, an approximate upper limit of useful particle sizes is in the range from about 0.005 inch to about 0.008 inch for particles that function with a good obturating effect. Combinations of more than one type or material or particle can be used to form the obturating medium, each of which can have the same approximate upper limit of useful particle sizes for good obturating effect. In one aspect, low density polyethylenes such as the Microthene® MN 701 series of polyethylenes work well, either alone or in combination with other obturating media materials.

A further aspect of the disclosure provides that a flow control additive can be used in conjunction with the obturating medium. A flow control additive usually takes the form of particles that can be larger than the obturating medium particles. Typically, the volume fraction of the flow control component is less than the volume fraction of the obturating medium particles. For example, a 2 parts by volume of obturating medium combined with 1 part by volume of a flow control component can be used. While not intending to be bound by theory, it appears that a mixture of a small fraction of larger flow control particles with a larger fraction of smaller obturating medium particles provides sufficient flowability for manufacturing ease, while maintaining good obturating performance. The smaller and the larger particles can have the same composition or can have different compositions. For example, a combination of small polyethylene or polypropylene obturating particles with larger polyethylene or polypropylene flow control particles provides a useful "combination" obturating material. In this aspect, for example, a relatively small size of low density polyethylene obturating material in combination with a larger particle size polypropylene flow control additive is useful.

The composition itself of the obturating medium 17 can be selected from any number of thermoplastics, thermosets, elastomers, thermoplastic elastomers, and other materials, including combinations thereof. A suitable obturating medium acts as a good seal under pressure, while also providing a thermal insulating effect which insulates and protects the projectile(s) from the intense heat of the powder combustion. This insulating effect of the obturating medium of this disclosure is provided without the obturating medium melting together to form a solid mass from the intense heat of combustion. This thermal insulating and gas-sealing effect of the obturating medium also allows a wide range or projectile types to be launched from a cartridge. Moreover, a suitable obturating medium does not deteriorate in performance in cold temperatures. The obturating medium also provides a cushion effect on the projectile(s) reducing deformation. Accordingly, in one aspect, suitable obturating medium 17 materials include, but are not limited to, various polyethylenes, polypropylenes, ethylene alpha-olefin copolymers (for example ethylene-1-hexene copolymers), propylene alpha-olefin copolymers (for example propylene-1-hexene copolymers), ethylene vinyl acetate copolymers, and the like, including any combinations or mixtures thereof, any polymer alloys thereof, or any copolymers thereof. Useful polyethylenes include high density polyethylenes, low density polyethylenes, and linear low density polyethylenes. Readily available and inexpensive low-density polyethylene, polypropylene, and combinations of polyethylene and polypropylene are suitable and relatively low cost obturating medium materials, which can provide a manufacturing advantage. Typically, when used, the flow control component can also be selected from a similar range of compositions as the obturating medium particles, although they usually take the form of larger particles than the obturating medium particles.

Yet a further aspect provides that the projectile material itself can function as both an obturating medium and a projectile. For example, the projectile material can be a particulate material to be launched from a cartridge such as a chemical powder. In this instance, the projectile material can exhibit obturating properties and be "self-sealing" when launched and therefore function as both the particulate obturating medium and the desired projectile. Embodiments of this aspect are found, for example, with powdered projectile materials having particle properties such as those disclosed herein for the obturating medium itself. In one embodiment, the projectile(s) can be a chemical powder of various compositions.

Any variety of projectile shapes, number, and types can be loaded into a cartridge using the wad-less method disclosed herein. For example, all sizes of lead-containing or lead-free projectiles can be employed, including all sizes of birdshot, buckshot, and slug projectiles. Any combination or mixture of shot sizes can be advantageously loaded using the wad-less method and obturating medium as provided herein. This technology is further applicable to ammunition loaded with shot comprising or consisting of steel, bismuth, tungsten, tin, iron, copper, zinc, aluminum, nickel, chromium, molybdenum, cobalt, manganese, antimony, alloys thereof, composites thereof, and any combinations thereof. Moreover, specialty cartridges can be advantageously loaded using the disclosed wad-less method, including but not limited to, frangible projectiles, rubber projectiles (for example, rubber shot, rubber rockets, and rubber baton projectiles), bean bag projectiles, tear gas or oleoresin capsicum (OC) projectiles, liquid-filled marking projectiles, tracer projectiles, penetrator projectiles (for example, steel penetrator or armor-piercing projectiles), flechette projectiles, incendiary projectiles (for example, titanium sponge-containing projectiles and zirconium sponge-containing projectiles), flare projectiles, chemical particulate projectiles, and the like.

Throughout this specification, various publications may be referenced. The disclosures of these publications in their entireties are hereby incorporated by reference in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes multiple particles of a chemical composition or mixture of compositions that constitutes a projectile, and the like.

Throughout the specification and claims, the word "comprise" and variations of the word, such as "comprising" and "comprises," means "including but not limited to," and is not intended to exclude, for example, other additives, components, elements, or steps. While compositions and methods are described in terms of "comprising" various components or steps, the compositions and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Unless indicated otherwise, when a range of any type is disclosed or claimed, for example a range of the particle sizes, percentages, temperatures, and the like, it is intended to disclose or claim individually each possible number that such a range could reasonably encompass, including any sub-ranges or combinations of sub-ranges encompassed therein. When describing a range of measurements such as sizes or weight percentages, every possible number that such a range could reasonably encompass can, for example, refer to values within the range with one significant figure more than is present in the end points of a range, or refer to values within the range with the same number of significant figures as the end point with the most significant figures, as the context indicates or permits. For example, when describing a range of particle sizes, such as from 0.001 inch to 0.008 inch, it is understood that this disclosure is intended to encompass each of 0.001 inch, 0.002 inch, 0.003 inch, 0.004 inch, 0.005 inch, 0.006 inch, 0.007 inch, and 0.008 inch, as well as any ranges, sub-ranges, and combinations of sub-ranges encompassed therein. Applicants' intent is that these two methods of describing the range are interchangeable. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed herein, and that each value is also herein disclosed as "about" that particular value in addition to the value itself.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

We claim:

1. A cartridge comprising:

a) a cartridge case having a proximal end and a distal end and, comprising a primer situated at the proximal end;

b) a propellant, a portion of which is contiguous with the primer;

c) a granulated obturating medium, a portion of which is contiguous with the propellant; and d) at least one projectile, a portion of which is contiguous with the obturating medium;

wherein the cartridge does not contain a pre-shaped gas seal.

2. A cartridge according to claim 1, wherein the distal end of the cartridge is crimped closed or partially crimped about the at least one projectile.

3. A cartridge according to claim 1, wherein a granulated obturating medium is mixed with the at least one projectile.

4. A cartridge according to claim 1, wherein the at least one projectile is insertably disposed over the obturating medium, and is compressed against a granulated obturating medium.

5. A cartridge according to claim 1, further comprising a polymer skirt extending about the at least one projectile, wherein the polymer skirt optionally comprises slits disposed along its body.

6. A cartridge according to claim 1, wherein a granulated obturating medium comprises a thermoplastic, a thermoset, an elastomer, a thermoplastic elastomer, or any combination thereof.

7. A cartridge according to claim 1, wherein a granulated obturating medium is selected from a polyethylene, a polypropylene, an ethylene alpha-olefin copolymer, a propylene alpha-olefin copolymer, an ethylene vinyl acetate copolymer, or any combination thereof.

8. A cartridge according to claim 1, wherein a granulated obturating medium comprises a polyethylene, a polypropylene, or a combination thereof.

9. A cartridge according to claim 1, wherein a granulated obturating medium further comprises a flow control additive.

10. A cartridge according to claim 1, wherein the cartridge is an ammunition cartridge, a flare cartridge; a grenade launcher cartridge, a smoke flare cartridge, a signaling device cartridge, a chemical munitions cartridge; a distraction device cartridge, or a pyrotechnic launching device cartridge.

11. A cartridge according to claim 1, wherein the at least one projectile is a frangible projectile, a rubber projectile, a bean bag projectile, a tear gas-containing projectile, an oleoresin capsicum-containing projectile, a liquid-filled marking projectile, a tracer projectile, a penetrator projectile, a flechette projectile, an armor-piercing projectile, an incendiary projectile, a flare projectile, a chemical particulate-containing projectile, or any combination thereof.

12. A cartridge according to claim 1, wherein the cartridge is an ammunition cartridge and the at least one projectile is lead-containing, lead-free, or a combination thereof.

13. A cartridge according to claim 1, wherein the cartridge is an ammunition cartridge and the at least one projectile comprises steel, bismuth, tungsten, tin, iron, copper, zinc, aluminum, nickel, chromium, molybdenum, cobalt, manganese, antimony, alloys thereof, composites thereof, or any combinations thereof.

14. A cartridge according to claim 1, wherein the cartridge is a shotshell cartridge and the at least one projectile is selected from birdshot, buckshot, and slug projectiles.

15. A cartridge comprising:

a) a cartridge case having a proximal end and a distal end and comprising a primer situated at the proximal end;

b) a propellant, a portion of which is contiguous with the primer;

c) a granulated obturating medium selected from polyethylene, polypropylene, or a combination thereof, a portion of which is contiguous with the propellant;

d) optionally, a flow control additive combined with the obturating medium; and d) at least one projectile, a portion of which is contiguous with the obturating medium;

wherein the cartridge does not contain a pre-shaped gas seal, and the distal end of the cartridge is crimped closed or partially crimped about the at least one projectile.

16. A cartridge according to claim 15, wherein the cartridge is a shotshell cartridge and the at least one projectile is selected from birdshot, buckshot, and slug projectiles.

17. A cartridge according to claim 15, wherein the cartridge is a shotshell cartridge and the at least one projectile comprises lead, steel, bismuth, tungsten, tin, iron, copper, zinc, aluminum, nickel, chromium, molybdenum, cobalt, manganese, antimony, alloys thereof, composites thereof, or any combinations thereof.

18. A shotshell comprising:

a) a shotshell case having a proximal end and a distal end and comprising a primer situated at the proximal end;

b) a propellant, a portion of which is contiguous with the primer;

c) a granulated obturating medium, a portion of which is contiguous with the propellant;

d) optionally, a flow control additive combined with the obturating medium; and e) at least one projectile selected from birdshot, buckshot, and slug projectiles, a portion of which is contiguous with the obturating medium;

wherein the shotshell does not contain a pre-shaped gas seal.

19. A shotshell according to claim 18, wherein a granulated obturating medium comprises a polyethylene, a polypropylene, or a combination thereof.

20. A cartridge comprising:

a) a cartridge case having a proximal end and a distal end and, comprising a primer situated at the proximal end;

b) a propellant, a portion of which is contiguous with the primer; and c) a particulate projectile material having obturating properties, a portion of which is contiguous with the propellant;

wherein the cartridge does not contain a pre-shaped gas seal.

* * * * *